US011667498B2

(12) United States Patent
Dhar et al.

(10) Patent No.: US 11,667,498 B2
(45) Date of Patent: Jun. 6, 2023

(54) AUTO ADJUST ELEVATOR DOOR SYSTEM

(71) Applicant: Otis Elevator Company, Farmington, CT (US)

(72) Inventors: Abhinav Dhar, Uttar Pradesh (IN); Amit Keshri, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 662 days.

(21) Appl. No.: 16/457,271

(22) Filed: Jun. 28, 2019

(65) Prior Publication Data

US 2020/0002135 A1 Jan. 2, 2020

(30) Foreign Application Priority Data

Jun. 29, 2018 (IN) ..... 201811024219

(51) Int. Cl.
*B66B 13/14* (2006.01)
*B66B 13/08* (2006.01)
*B66B 13/26* (2006.01)

(52) U.S. Cl.
CPC ..... *B66B 13/146* (2013.01); *B66B 13/08* (2013.01); *B66B 13/26* (2013.01)

(58) Field of Classification Search
CPC ..... B66B 13/146; B66B 13/08; B66B 13/26; B66B 1/2408; B66B 5/0012
See application file for complete search history.

(56) References Cited

U.S. PATENT DOCUMENTS 5,235,143 A * 8/1993 Bahjat ..... B66B 13/143 187/316
5,286,930 A * 2/1994 Bittar ..... B66B 13/146 187/316

(Continued)

FOREIGN PATENT DOCUMENTS

CN 101531320 B 9/2009
CN 107473029 A 12/2017

(Continued)

OTHER PUBLICATIONS

AI Supervisory Control System, Mitsubishi Electric, Retrieved: May 3, 2018; http://www.hmecg.com/innovation-2.php; 5 Pages.

(Continued)

*Primary Examiner* — Jeffrey Donels
(74) *Attorney, Agent, or Firm* — Cantor Colburn LLP

(57) ABSTRACT

A system including one or more processors, one or more non-transitory storage mediums, a data file, and executable instructions. The processor is configured to receive a door close signal from a door close selector and a door open signal from at least one of a door open selector and a door obstructed sensor. The data file is stored in the non-transitory storage medium and includes a door open time duration associated with at least one of the door open signal and the door close signal. The executable instructions are stored in the non-transitory storage medium and is executed by the processor. The executable instructions are configured to generate the door open time duration based on at least one of the door open signal and the door close signal. The processor is configured to output a door open command based, at least in-part, on the door open time duration.

14 Claims, 2 Drawing Sheets

(56) References Cited

U.S. PATENT DOCUMENTS

| | | | | |
|---|---|---|---|---|
| 5,387,768 | A * | 2/1995 | Izard | G06F 7/00 187/392 |
| 8,151,943 | B2 | 4/2012 | De Groot | |
| 8,397,874 | B2 | 3/2013 | De Groot | |
| 8,573,366 | B2 | 11/2013 | Elomaa et al. | |
| 8,880,200 | B2 | 11/2014 | Nowel | |
| 2003/0168288 | A1* | 9/2003 | Deplazes | B66B 13/26 187/317 |
| 2006/0037818 | A1* | 2/2006 | Deplazes | G08B 13/1961 187/392 |
| 2009/0057068 | A1* | 3/2009 | Lin | B66B 1/34 187/392 |
| 2016/0031675 | A1* | 2/2016 | Silvennoinen | G05B 15/02 187/247 |
| 2016/0052748 | A1 | 2/2016 | Siikonen et al. | |
| 2016/0289043 | A1* | 10/2016 | Fang | B66B 1/3461 |
| 2016/0368732 | A1* | 12/2016 | Zhao | B66B 1/468 |
| 2017/0197807 | A1* | 7/2017 | Noda | B66B 13/143 |

FOREIGN PATENT DOCUMENTS

| | | | |
|---|---|---|---|
| DE | 69205949 | T2 | 7/1996 |
| EP | 0452130 | A2 | 4/1991 |
| EP | 2311769 | B1 | 4/2015 |
| JP | 2009215040 | A | 9/2009 |
| JP | 2014047015 | A | 3/2014 |
| JP | 2016060549 | A | 4/2016 |
| JP | 6335222 | B2 | 5/2018 |
| WO | 2011132261 | A1 | 10/2011 |

OTHER PUBLICATIONS

Crites, R. et al. "Improving Elevator Performance Using Reinforcement Learning", Computer Science Department, Univ. of Massachusetts, Amherst, MA 01003-461, Retrieved: May 11, 2018, https://papers.nips.cc/paper/1073-improving-elevator-performance-using-reinforcement-learning.pdf; 7 Pages.

Debnath, J. et al. "Real-Time Optimal Scheduling of a Group of Elevators in a Multi-Story Robotic Fully-Automated Parking Structure", Procedia Computer Science, 2015, vol. 61, pp. 507-514.

Hitachi Machine Room-less Elevator, Model UAG, Series 2T, Retrieved: May 11, 2018; http://www.hea.hitachi.com.sg/assets/downloads/UAG-2T.pdf; 19 Pages.

Jamaludin, J. et al. "An Elevator Group Control System With a Self-Tuning Fuzzy Logic Group Controller", IEEE Transactions on Industrial Electronics, Dec. 2010, vol. 57, No. 12, pp. 4188-4198.

Search Report for European Application No. 19183695.6 dated Nov. 28, 2019; 9 pages.

Chinese Application No. 201910574907.1 filed Jun. 28, 2019; Chinese Office Action dated May 6, 2021; 13 pages.

* cited by examiner

AUTO ADJUST ELEVATOR DOOR SYSTEM

CROSS REFERENCE TO RELATED APPLICATIONS

This application claims priority to India Patent Application No. 201811024219 filed on Jun. 29, 2018, which is incorporated herein by reference in its entirety.

BACKGROUND

The present disclosure relates to an elevator, and more particularly, to a system of the elevator that detects and adjusts elevator door open times.

Traditional elevator doors remain open for a fixed duration of time and are generally insensitive to peak and non-peak hours of passenger traffic.

BRIEF DESCRIPTION

A system according to one, non-limiting, exemplary embodiment of the present disclosure includes one or more processors, one or more non-transitory storage mediums, a data file, and executable instructions. The processors are configured to receive a door close signal from a door close selector and a door open signal from at least one of a door open selector and a door obstructed sensor; one or more non-transitory storage mediums. The data file is stored in the one or more non-transitory storage mediums and including a door open time duration associated with at least one of the door open signal and the door close signal. The executable instructions are stored in the one or more non-transitory storage mediums and is executed by the one or more processors. The executable instructions are configured to generate the door open time duration based on at least one of the door open signal and the door close signal. The processors are configured to output a door open command based, at least in-part, on the door open time duration.

Additionally, to the foregoing embodiment, the door close selectors are adapted to open and close an elevator car door.

In the alternative or additionally thereto, in the foregoing embodiment, the door open signal is one of a plurality of door open signals, the door close signal is one of a plurality of door close signals, and the one or more processors via the executable instructions are configured to receive a plurality of elevator car locations and associate at least one of the plurality of door open signals to a respective one of the elevator car locations and associate at least one of the plurality of door close signals to the respective one of the elevator car locations.

In the alternative or additionally thereto, in the foregoing embodiment, the door open time duration is one of a plurality of door open time durations, and each one of the plurality of door open time durations is associated with a respective one of the plurality of elevator car locations.

In the alternative or additionally thereto, in the foregoing embodiment, the plurality of elevator car locations is a plurality of floors.

In the alternative or additionally thereto, in the foregoing embodiment, the door open time duration is greater than a preprogrammed minimum threshold value and less than a preprogrammed maximum threshold value.

In the alternative or additionally thereto, in the foregoing embodiment, the door open time duration is a function of a time of day stored in the data file.

In the alternative or additionally thereto, in the foregoing embodiment, the door open time duration is a function of a day in a week stored in the data file.

In the alternative or additionally thereto, in the foregoing embodiment, each one of the plurality of door open time durations is a function of a time of day stored in the data file.

In the alternative or additionally thereto, in the foregoing embodiment, each one of the plurality of door open time durations is a function of a day in a week stored in the data file.

In the alternative or additionally thereto, in the foregoing embodiment, each one of the plurality of door open time durations is a function of elevator car traveling direction.

In the alternative or additionally thereto, in the foregoing embodiment, the one or more processors and the one or more non-transitory storage mediums are part of a cloud.

In the alternative or additionally thereto, in the foregoing embodiment, the executable instructions include machine learning to determine the door open time duration.

A method of operating an auto adjust door system according to another, non-limiting, embodiment includes preprogramming a minimum and a maximum threshold value as part of a data file stored in an electronic storage medium. Preprogramming an initial prescribed door open time duration as part of the data file and being equal to one of, or falling between, the minimum and maximum threshold values. Tracking at least one of a car location, a time of day, a day of the week, and a direction of car travel and recording as tracked data of the data file. Receiving at least one of a door open signal and a door close signal by a processor. Associating the at least one of a door open signal and the door close signal to the tracked data. Then, determining a plurality of time duration adjustments by executable instructions stored in the electronic storage medium and executed by the processor based on the door open and door close signals and associated with the tracked data.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
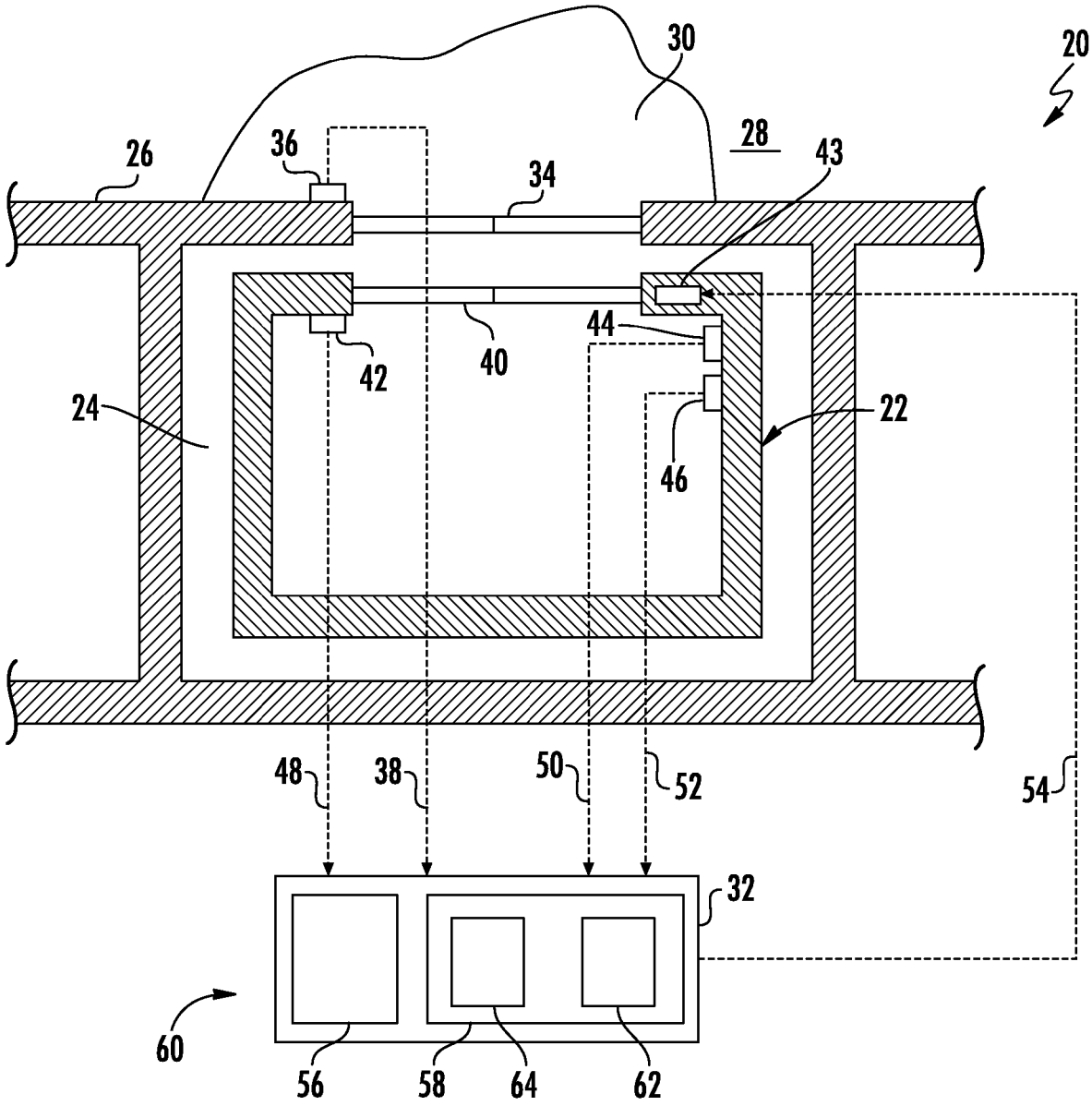
FIG. 1 is a schematic of an elevator system in an exemplary embodiment of the present disclosure.

Referring to FIG. 1, an exemplary embodiment of an elevator system 20 is illustrated. The elevator system 20 may include at least one elevator car 22 adapted to move within a hoistway 24 having boundaries defined by a structure or building 26. In general, the hoistway 24 extends in at least a vertical direction, and communicates through a multitude of floors 28 of the building 26. Each floor 28 may be associated with at least one landing 30 generally situated adjacent to the hoistway 24. The elevator system 20 further includes at least one control-circuitry 32, at least one landing door 34 that serves the respective at least one landing 30, and at least one door obstruction sensor 36 mounted adjacent to (or as an integral part of) the landing door 34. The obstruction sensor 36 may be configured to send an obstruction, or door open, signal (see arrow 38) to the control-circuitry 32 when an obstruction is sensed that may prevent automatic closure of the landing door 34.

Each elevator car 22 may include at least one car door 40, a car door obstruction sensor 42, a door actuator 43, a door close selector 44, and a door open selector 46. The car door obstruction sensor 42 is configured to send an obstruction signal (see arrow 48) to the controller 32. The door actuator 43 is adapted to provide automatic opening and closing of the doors 34, 40 as dictated by the control-circuitry 32. The door close and door open selectors 44, 46 are configured to send respective close and open signals (see arrows 50, 52) to the control-circuitry 32. It is contemplated and understood that the elevator system 20 may include only the obstruction sensors 36 located at each landing 30 and not include the obstruction sensor 42 carried by the elevator car 22. Alternatively, the car door obstruction sensor 42 may be adapted to detect obstructions occurring at the landing door 34 and the adjacent car door 40, therefore the elevator system may not include the landing door obstruction sensors 36. It is contemplated and understood that the door actuator 43 may generally actuate the car door 40 and a mechanical linkage may catch the landing door 34 causing the landing door 34 to move with the car door 40, or vice versa. Alternatively, both doors 34, 40 may include respective, dedicated, actuators controlled by the control-circuitry 32.

During normal operation, the car door 40 and the landing door 34 (i.e., associated with a specific landing 30) generally function in unison. When waiting occupant(s) enter the elevator car 22, the doors 34, 40 remain open for a prescribed time duration. This duration of time along with the opening and closing of the doors 34, 40 is generally controlled by the control-circuitry 32. If many occupants enter the elevator car 22 at a single stop or landing 30, and/or many occupants must exit the car, the required time to unload then load the car 22 may be exceeded. In this case, one or both of the obstruction sensors 36, 42 may sense this occurrence (i.e., sense the resulting obstruction) and send the respective signals 38, 48 to the controller 32. As a result, the controller 32 may send a command signal (see arrow 54) directing the actuator 43 to delay closure of the doors 34, 40 (or reverse the closing of the doors). Similarly, an occupant in the elevator car 22 may see that waiting occupants are still boarding the car 22 and may choose to select the door open selector 46 sending the open signal 52 to the control-circuity 32. Upon receipt of the open signal 52, the control-circuitry 32 may then send the command signal 54 to the actuator 43 to delay closure.

In another operating scenario, the elevator car 22 may be fully boarded. In this case, an occupant may choose to select the door close selector 44 as oppose to waiting for the prescribed time duration to fully run. The control-circuitry 32 receives the close signal 50 and outputs a command signal 54 causing the actuator 43 to begin closure of the doors 34, 40. It is contemplated and understood that the selectors 44, 46 may be any type of device, or means, which enables the occupant to make a selection. Examples may include a mechanical button, fields in a touch screen display, and others.

Figure 2:
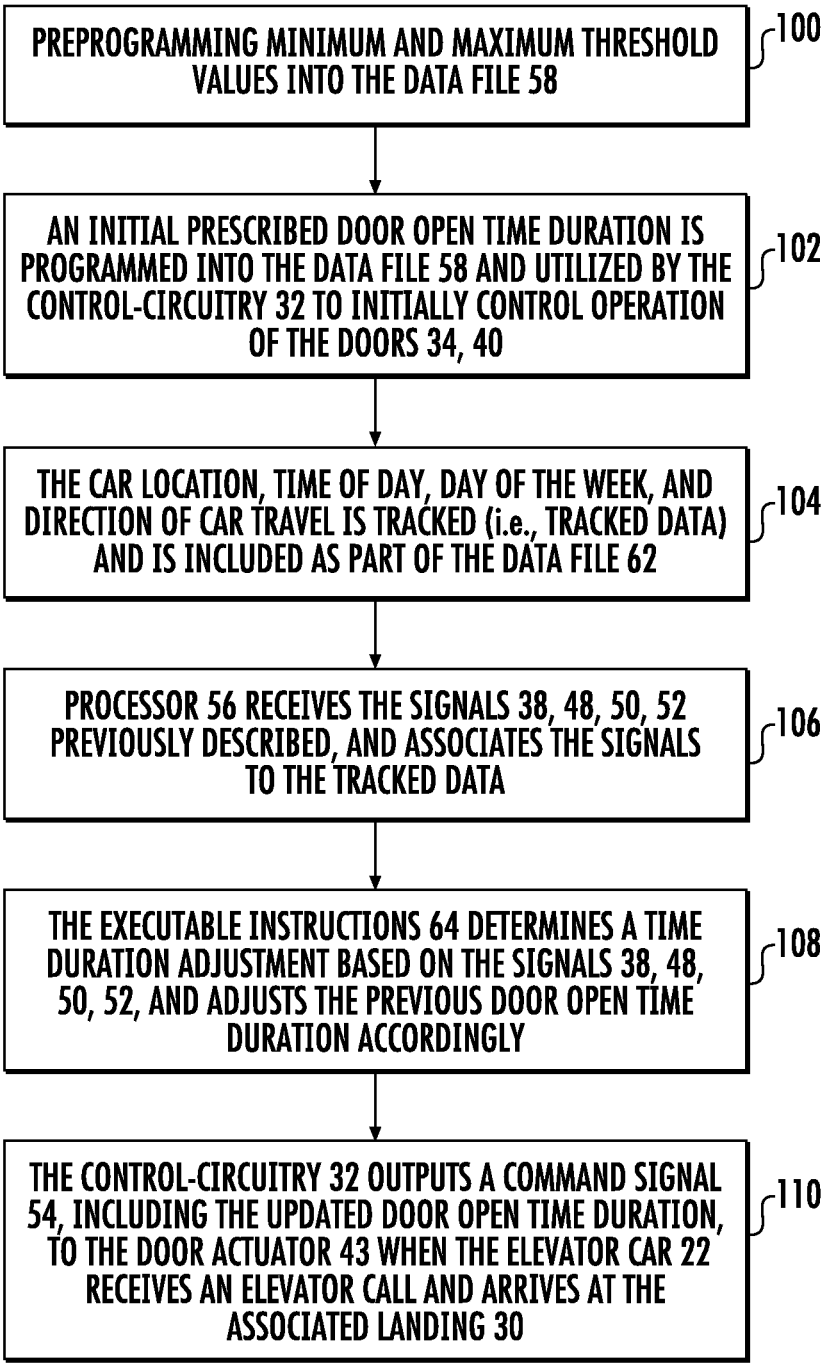
FIG. 2 is a flow chart of a method of operating an auto adjust door system of the elevator system.

Referring to FIG. 2, the at least one control-circuitry 32 includes one or more processors 56 (e.g., microprocessors) configured to receive the signals 38, 48, 50, 52 and output the signal 54, and one or more non-transitory storage mediums 58 that may be computer readable and writeable. The elevator system 20 may further include an auto adjust door system 60 having a data file 62, and executable instructions 64 configured to generate one or more door open time durations. The data file 62 and the executable instructions 64 may be stored in the storage medium 58. The data file 62 is generally applied to the executable instructions 64 when the instructions are executed by the processor 56. In one embodiment, the auto adjust door system 60 may further include, or may share the function of, the selectors 44, 46, one or both of the obstruction sensors 36, 42, and the control-circuitry 32. It is further contemplated and understood that at least a portion of the auto adjust door system 60 may be part of a cloud server in wireless communication with for example, a local portion of the control-circuitry 32.

The data file 62 may include a plurality of prescribed door open time durations, a preprogrammed minimum threshold value, and a preprogrammed maximum threshold value. The prescribed door open time duration may not be less that the preprogrammed minimum threshold value and may not be greater than the preprogrammed maximum threshold value. Each landing 30 (i.e., each elevator car location) may be associated with a different prescribed door open time duration as dictated by the elevator car usage at, for example, a particular floor 28. Each prescribed door open time duration may also be a function of time, and function of the day in a week, and other influences. That is, car usage at a particular landing 30 (e.g., lobby), on a Monday, and at 8 a.m., may be particularly high because people are arriving to work. Therefore, the door open time duration will be particularly long. In contrast, at the same landing, the same time of day, but on a Sunday, traffic to and from the elevator car 22 may be low because people are not working, thus the door open time duration may be relatively short. It is contemplated and understood that the door open time duration may also be impacted (i.e., is a function of) whether the elevator car travel is going up or down.

The auto adjust door system 60 functions to optimize the multitude of door open time durations via machine learning and/or application of one or more algorithms as part of the executable instructions 64. The data file 62 may be an array or matrix of data used to determine the door open time duration by the processor 56 and instructions 64. The door open time duration is dependent upon the landing or elevator car location, the time of day, the day of the week, the direction of elevator car travel, and data received from the various signals 38, 48, 50, 52.

Referring to FIG. 2, and with continued reference to FIG. 1, a method of operating the auto adjust door system 60 includes at block 100, preprogramming minimum and maximum threshold values into the data file 58. At block 102, an initial prescribed door open time duration is programmed into the data file 58 and utilized by the control-circuitry 32 to initially control operation of the doors 34, 40. At block 104, the car location, time of day, day of the week, and direction of car travel is tracked (i.e., tracked data) and is included as part of the data file 62. At block 106, the processor 56 receives the signals 38, 48, 50, 52 previously described, and associates the signals to the tracked data. At block 108, the executable instructions 64 determines a time duration adjustment based on the signals 38, 48, 50, 52 and adjusts the previous door open time duration accordingly. At block 110, the control-circuitry 32 outputs a command signal 54, including the updated door open time duration, to the door actuator 43 when the elevator car 22 receives an elevator call and arrives at the associated landing 30. The data file 64 may include a different door open time duration for each landing 30 of a plurality of landings in a building 26 with multiple floors.

That is, any one of the door open signals 38, 48, 52 is a plurality of door open signals, and the door close signal 50 is a plurality of door close signals, with each of the open and closed signals associated with a respective landing, associated with a respective time, associated with a respective day of the week, and associated with a respective direction of car travel (i.e. up or down.).

In one embodiment, the executable instructions 64 may apply a multitude of data associated with a multitude of signals 38, 48, 50, 52 received from many occurrences of occupants wanting to prematurely close the elevator doors 34, 40, and/or keep the elevator doors open for an extended period of time. In this way, the executable instructions 64 may apply an averaging technique and/or machine learning.

The control-circuitry 32, or portions thereof, may be part of, one or more Application Specific Integrated Circuit(s) (ASIC), electronic circuit(s), central processing unit(s) (e.g., microprocessor and associated memory and storage) executing one or more software or firmware programs and routines, combinational logic circuit(s), input/output circuit(s) and devices, appropriate signal conditioning and buffer circuitry, and other components to provide the described functionality.

Software, modules, applications, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators and other devices The present disclosure may be a system, a method, and/or a computer program product. The computer program product may include a computer readable storage medium (or media) having computer readable program instructions thereon for causing a processor to carry out aspects of the present disclosure.

The computer readable storage medium(s) can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Benefits and advantages of the present disclosure include an immediate reaction to occupant feedback based one, for example, machine learning, less power consumption by elevator system, since door actuator (i.e., electric motor) is optimally used, improved occupant experience, and improved detection of peak and non-peak traffic hours in a building based on real time traffic data.

While the present disclosure is described with reference to exemplary embodiments, it will be understood by those skilled in the art that various changes may be made, and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A system comprising:

one or more processors configured to receive a door close signal from a door close selector and a door open signal from at least one of a door open selector and a door obstructed sensor;

one or more non-transitory storage mediums;

a data file stored in the one or more non-transitory storage mediums and including an initial door open time duration; and executable instructions stored in the one or more non-transitory storage mediums and executed by the one or more processors, the executable instructions configured to generate an adjustment to the initial door open time duration based on a set of door open signals and a set of door close signals;

wherein each door open signal in the set of door open signals represents an attempt by any one of a plurality of occupants to keep one of a plurality of elevator car doors open beyond the initial door dwell time;

wherein each door close signal in the set of door close signals represents an attempt by any one of the plurality of occupants to close one of the plurality of elevator car doors in less than the initial door dwell time; and wherein the one or more processors are configured to output a door open command based at least in-part on the initial door open time duration and the adjustment to the initial door open time duration.

2. The system set forth in claim 1, wherein the door close selectors are adapted to open and close the plurality of elevator car doors.

3. The system set forth in claim 2, wherein the executable instructions are further configured to generate the adjustment to the initial door open time duration based on a plurality locations of the plurality of elevator car doors.

4. The system set forth in claim 3, wherein the adjustment to the initial door open time duration is one of a plurality of adjustments to the initial door open time durations, and each one of the plurality of adjustments to the initial door open time durations is associated with a respective one of the plurality of locations of the plurality elevator car doors.

5. The system set forth in claim 4, wherein the plurality of elevator car door locations is a plurality of floors.

6. The system set forth in claim 1, wherein the adjustment to the initial door open time duration is a function of a time of day stored in the data file.

7. The system set forth in claim 6, wherein the adjustment to the initial door open time duration is a function of a day in a week stored in the data file.

8. The system set forth in claim 4, wherein each one of the plurality of adjustment to the initial door open time duration is a function of a time of day stored in the data file.

9. The system set forth in claim 8, wherein each one of the plurality of adjustments to the initial door open time duration is a function of a day in a week stored in the data file.

10. The system set forth in claim 4, wherein each one of the plurality of adjustments to the initial door open time duration is a function of elevator car traveling direction.

11. The system set forth in claim 9, wherein each one of the plurality of adjustments to the initial door open time duration is a function of elevator car traveling direction.

12. The system set forth in claim 1, wherein the one or more processors and the one or more non-transitory storage mediums are part of a cloud.

13. The system set forth in claim 1, wherein the executable instructions include machine learning operable to use the set of door open signals and the set of door close signals to determine the adjustment to the initial door open time duration.

14. The system set forth in claim 4, wherein the executable instructions include machine learning operable to use the set of door open signals and the set of door close signals to determine the plurality of adjustments to the initial door open time duration.

* * * * *